United States Patent [19]

Colston

[11] 4,376,620

[45] Mar. 15, 1983

[54] SEAWATER HYDRAULIC VANE-TYPE MOTOR

[75] Inventor: John R. Colston, Annapolis, Md.

[73] Assignee: Westinghouse Electric Corp., Pittsburgh, Pa.

[21] Appl. No.: 184,682

[22] Filed: Sep. 8, 1980

[51] Int. Cl.[3] ..... F01C 19/08; F03C 2/00

[52] U.S. Cl. ..... 418/79; 418/102; 418/133; 418/152; 418/267

[58] Field of Search ..... 418/79, 82, 102, 133, 418/152, 267, 268

[56] References Cited

U.S. PATENT DOCUMENTS

| | | | |
|---|---|---|---|
| 2,371,081 | 3/1945 | Tucker et al. | 418/268 |
| 2,435,279 | 2/1948 | Hubacker | 418/267 |
| 3,255,704 | 6/1966 | Mazur | 418/79 |
| 3,609,071 | 9/1971 | Brown | 418/267 |
| 3,752,609 | 8/1973 | Niemiec et al. | 418/133 |
| 3,792,936 | 2/1974 | Pettibone et al. | 418/133 |

*Primary Examiner*—John J. Vrablik

*Attorney, Agent, or Firm*—W. G. Sutcliff

[57] ABSTRACT

A vane type hydraulic motor which is operable with seawater as the hydraulic fluid for undersea diver use. The motor is compact, lightweight and is lubricated by the seawater working fluid. The motor uses corrosion resistant materials with the requisite flexibility, mechanical strength, friction characteristics and low swelling rate when immersed in seawater. The motor structure provides durable seal means and pressure balanced operation which minimizes wear. The vane structure permits easy sliding vane movement, and uses the seawater pressure to control vane movement and sliding seal capability.

9 Claims, 9 Drawing Figures

SEAWATER HYDRAULIC VANE-TYPE MOTOR

BACKGROUND OF THE INVENTION

The present invention relates to vane-type hydraulic motors, and more particularly one in which filtered seawater is used as the high pressure hydraulic fluid. This seawater hydraulic motor is designed for underwater usage by divers performing a variety of tasks with the compact lightweight motor.

Prior art hydraulic motors designed for underwater usage have typically employed oil as the hydraulic fluid. The hydraulic fluid is pumped from a surface craft through an inlet hose down to the diver, and must be returned via a return hose. The need for such supply and return hoses limit the diver's handling of the motor, particularly where heavy surge and strong currents exist. The use of oil as the hydraulic fluid creates logistic problems in requiring shipping and storage of large quantities of oil. Leakage of the oil fluid from the motor contaminates the environment, and leakage of seawater into the motor readily damages the precision motor components.

A variety of vane-type hydraulic motors which utilize oil as the working pressurized fluid are seen in U.S. Pat. Nos. 3,981,648; 2,371,081; and 3,752,609. In each of the above-cited prior art vane-type hydraulic motors, which use oil as the working fluid, a rotor turns within a non-circular cam ring as the sliding vanes mounted in the perimeter of the rotor follow the cam ring in proceeding from the high pressure inlet position to the low pressure outlet position. The vanes are radially slidable within slots provided in the rotor and a spring means may be mounted in the base of the vane to urge the vane radially outward against the cam ring. In U.S. Pat. No. 3,981,648, the structure provides high pressure hydraulic fluid to the base of the vanes within the rotor slots to further urge the vane radially outward against the cam ring. This structure comprises an enlarged slot opening between the inward extending end of the slot and the rotor perimeter and also includes a plurality of fluid supply apertures or ports leading from the pressurized fluid inlet, which ports are aligned with a slot enlargement portion in the rotor. In this prior art reference the motor end plates are sealed to the rotor and cam ring track via O-ring seal means.

In U.S. Pat. No. 3,752,609 flexible seal plates are disposed between the rotor and cam ring and the motor enclosure or body. These flexible seal plates are formed of a bimetallic sheet metal material, such as steel and bronze, with the steel forming a resilient flexible support for the bronze bearing material which is adjacent to the rotor. Apertures are provided through the seal plates to permit high pressure hydraulic fluid to be admitted to the space between the rotor and the cam ring track and also to be admitted to the rotor slots to provide a radially outward force upon the vanes which fit within the slots.

U.S. Pat. No. 2,371,081 shows a tapered vane structure, which the vane side faces having undercut portions toward the lower edge. The taper of vanes and the undercut portion facilitate passage of the pressurized fluid to the base of the vane to further assist in urging the vane radially outward into sliding engagement with the cam ring track.

The design of a vane-type hydraulic motor which utilizes seawater as the hydraulic fluid presents a serious challenge because of the general corrosiveness of the seawater on precision made parts of such motors. The poor lubricity of seawater and a much lower viscosity for seawater than for conventional oil hydraulic fluid contribute to the problem. The generally lower viscosity which seawater exhibits means that all design clearances must be an order of magnitude less than for prior art oil hydraulic fluid motors. The motor is designed so that seawater also acts as the lubricant for wear surfaces.

SUMMARY OF THE INVENTION

A vane-type hydraulic motor operable with seawater as the hydraulic fluid has been provided in a compact light weight motor design in which all critical bearings and dynamic seals use a flexible high corrosion resistant, low friction flexible material. The vanes as well as flexible seal plate members are formed of this flexible bearing material. The motor body is formed of high corrosion resistant nickel alloy. The side seal plates are flexible and pressure balanced and act as thrust bearings about the shaft, as well as sealing surfaces about the rotor. The shaft when connected to a tool will have some axial force along the shaft which can be a leak path for the hydraulic fluid. The flexible, tight fitting side seal plates act as a thrust bearing when seated on the shaft to minimize leakage of fluid along the shaft. The vanes are spring biased radially outward from the rotor axis with a pair of springs disposed within apertures provided in the vane base. The spring loaded vanes are generally rectangular members having an arcuate outer end portion which serves as a sliding seal against the cam ring track. The vane members have side faces normal to the direction of rotor rotation, which side faces include grooves which extend along the entire opposed side face extent in a direction normal to the direction of rotation. A radially extending slot extends from the groove to the base of the vane to facilitate passage of pressurized seawater to the base of the vane to assist in urging the vane radially outward against the cam ring track.

DESCRIPTION OF THE PREFERRED EMBODIMENTS

Figure 1:
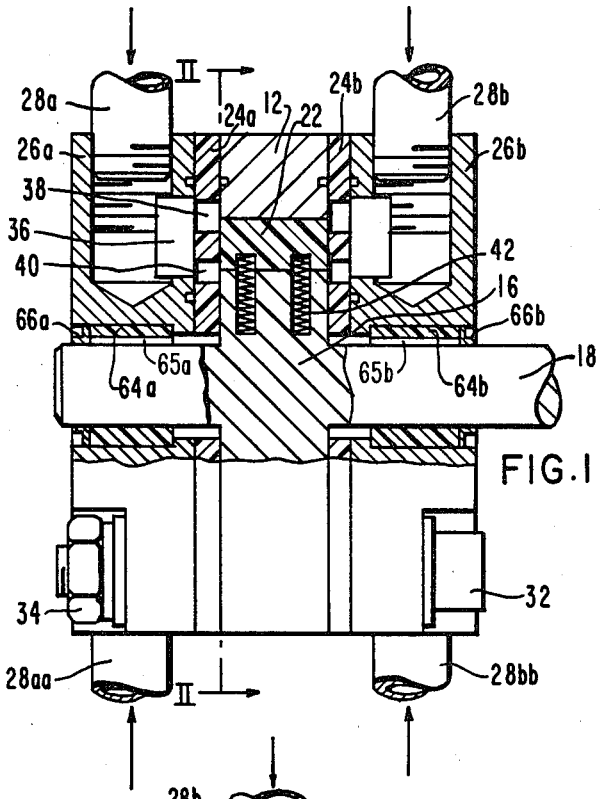
FIG. 1 is a side elevational view partly in section of the seawater hydraulic motor of the present invention.
Figure 2:
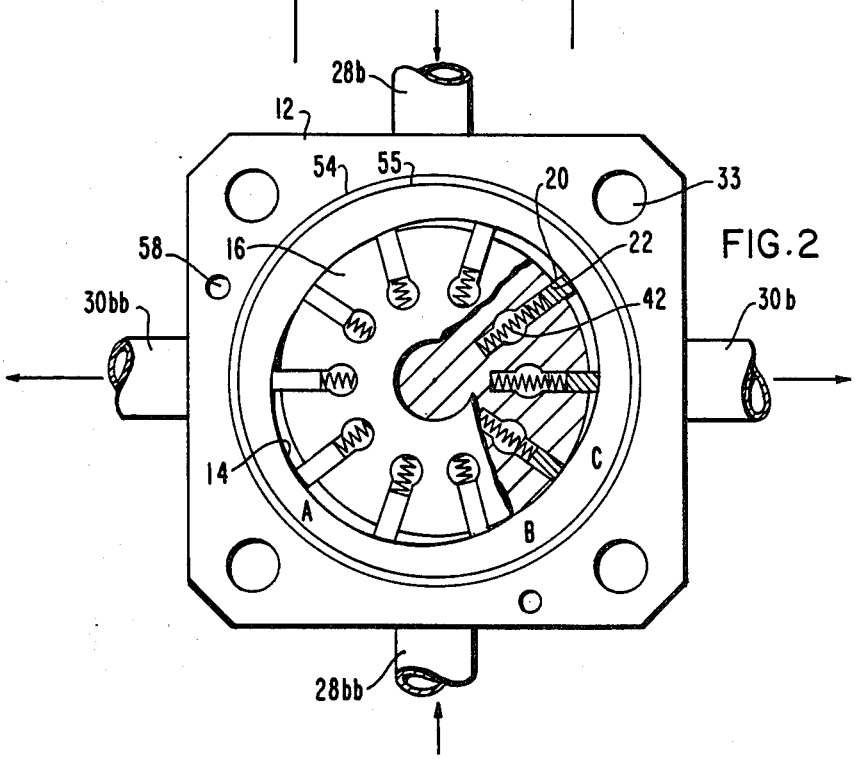
FIG. 2 is a view along the line II—II of FIG. 1 looking toward the cam ring track and the rotor structure of the hydraulic motor.

The seawater hydraulic motor 10 comprises a centralized ring member 12 having an eccentric cam ring track interior surface 14 with a major and minor diameter portion. A rotor 16 is disposed within the ring with an integral central axially extending shaft 18. A plurality of circumferentially spaced-apart slots 20 are provided in the perimeter of the rotor and accept sliding vanes 22.

A pair of flexible side seal plates 24*a* and 24*b* are disposed on either side of the rotor 16 and ring 14 in sliding seal relationship with the rotor. A pair of end plates 26*a*, 26*b* are sealed to the respective flexible side seal plates 24*a* and 24*b* to complete the motor body structure. A plurality of inlet ports 28*a*, 28*b* and 28*aa*, 28*bb* are provided for each end plate with a pair of outlet ports 30*a*, 30*b* and 30*aa*, 30*bb*. The motor is a balanced rotor device to minimize loads on the shaft and thrust bearings, and is balanced by the two inlet and two outlet ports in each end plate, and thus a total of four inlet and four outlet ports for the entire motor. The inlet and outlet ports are symmetrically arranged radially and axially with respect to the rotor. A plurality of bolts 32 pass through aligned apertures 33 in the respective end plates 26*a*, 26*b*, seal plates 24*a*, 25*b*, and ring member 14, and are engaged by nut members 34 to hold the motor structure together. The bolts are arranged symmetrically at the four corners of the generally square end plates.

The end plates 26*a*, 26*b* are provided with internal fluid passage ways 36 which communicate with aligned apertures 38 and 40 in the flexible side seal plates to admit pressurized seawater into the space between the rotor and the cam ring track at the major diameter portion of the cam ring track, and to provide an outlet for the seawater at the minor diameter portion of the cam ring track. More specifically, the aperture 38 in the flexible side seal plate communicates with the space between the rotor and the cam ring track. The aperture 40 is aligned with the base of the slots 20 to admit pressurized seawater to the base of the slot so that it can act to radially force the vane outwardly against the cam ring track. A pair of spring members 42 fit within apertures 44 provided in the base of the vanes.

Figure 6A:
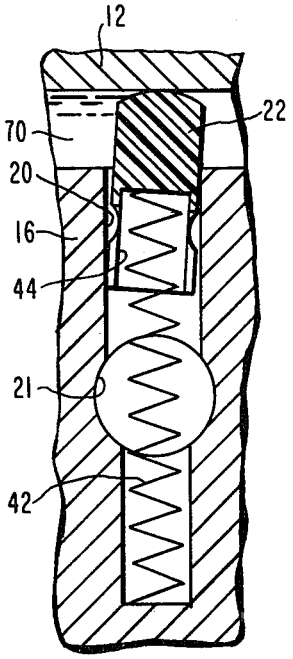
FIG. 6A is a schematic illustration of one of the vanes in a rotor slot at a position along the ring track where the high pressure seawater is acting against the vane to rotate the rotor.

The vane members 22 have an arcuate outer end portion 46 which serves as a sliding seal against the eccentric or cammed ring track as the rotor and vanes rotate. The vanes 22 are generally rectangular in configuration with the larger area side faces 48 upon which the pressurized seawater is directed including side face grooves 50 which extend along the radial extend of the vane such as to closely approach the perimeter of the rotor when the vane is in the fully radially outwardly extended position as seen in FIG. 6A. A radially extending slot 52 is provided in each vane side face 48 extending from the groove 50 to the base of the vane. This radially extending slot 52 is aligned with and leads into the spring apertures 44 provided in the base of the vane.

Figure 3:
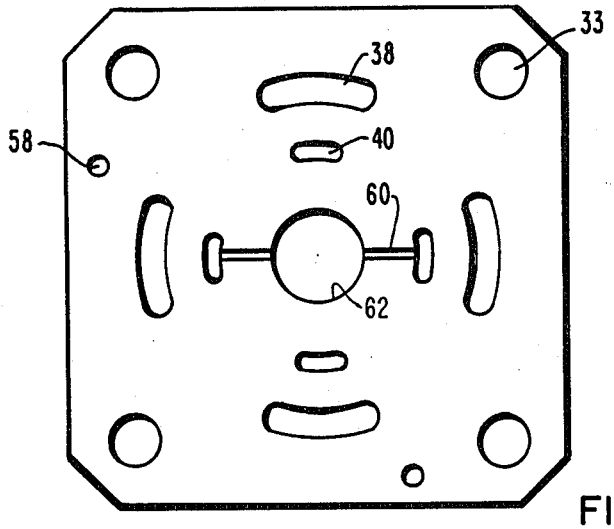
FIG. 3 is a side elevational view of a flexible side seal plate as seen from the side facing the rotor of the motor.
Figure 4:
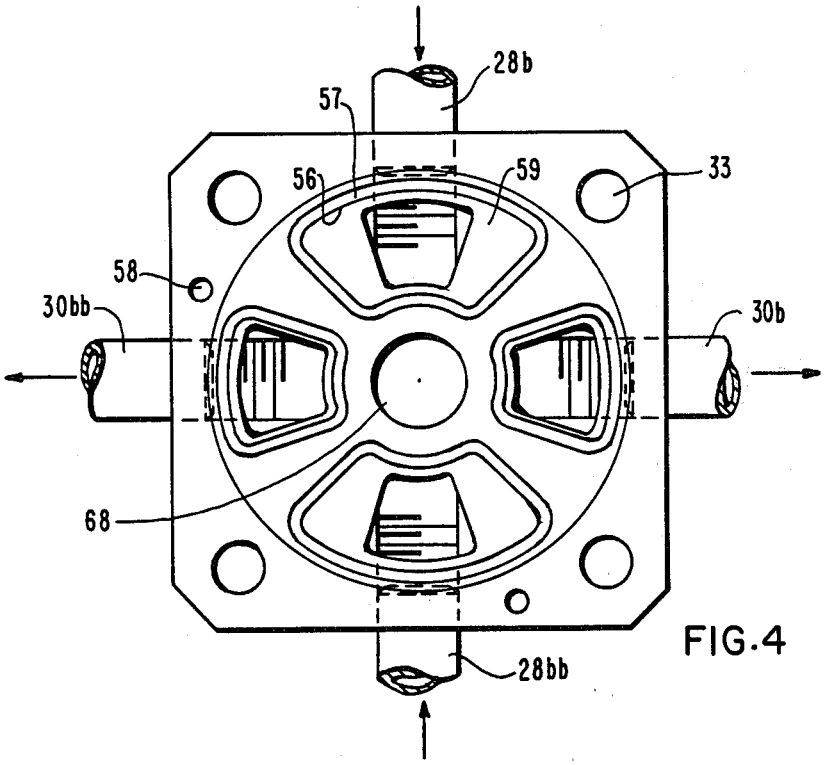
FIG. 4 is a side elevational view of the end plate viewed from the direction of the rotor of the motor.

To facilitate sealing of the motor to insure that the pressurized seawater is directed against the rotatable vanes to turn the rotor, an annular O-ring receiving channel 54 is provided in each of the side faces of the cam ring track 14 with a suitable annular O-ring 55 seated therein and sealed against the flexible side seal plates 24*a*, 24*b* when the motor is assembled. As best seen in FIG. 4, an O-ring channel 56 and O-ring 57 is provided about each of the inlet and outlet ports or passageways on the face of the end plate which abuts the side seal plates. The O-ring channels are provided about generally fan shaped pressure pad areas 59 on the face of the end plates, which pressure pad areas are dimensioned to provide a pressure balance on the side seal plates and rotor. Alignment apertures 58 extend through the ring track, the side seal plates, and the end plates to facilitate assembly of the motor or components with an alignment pin fitted in apertures 58. As best seen in FIG. 3 the flexible side seal plates 24*a*, 24*b* include a pair of radial grooves 60 extending between the apertures 40 through which vented seawater is admitted from the outlet ports to the central aperture 62 in side seal plates through which the shaft 18 extends. These radial grooves 60 in the flexible side seal plates act as a seawater flow path to the rotor shaft to facilitate lubrication, cooling and carrying away of contaminate from the side seal plates and the shaft. A pair of annular axial bearings 64*a*, 64*b* are mounted about the shaft 18 within central aperture 68 provided through the end plates 26*a*, 26*b*. These axial bearings 64*a*, 64*b* include axial grooves 65*a*, 65*b* provided along the interior surfaces of the respective axial bearings, which interior surfaces are seated on the shaft. In this way lubricating seawater flows along the shaft. A close clearance annular seal means or dirt seal 66*a*, 66*b* is provided about the shaft at the extending ends of the axial bearings within the central aperture 68 through the end plates.

Figure 5A:
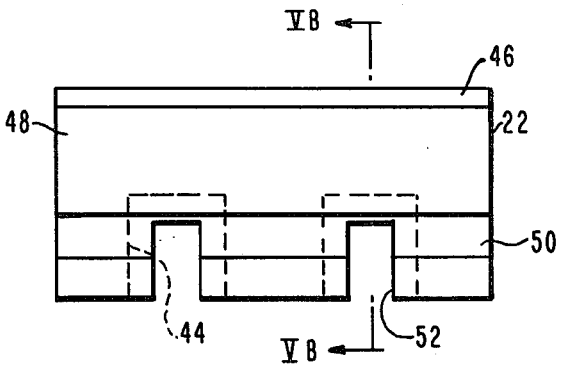
FIG. 5A is a side elevational view enlarged showing of the vane structure used in the present invention.
Figure 5B:
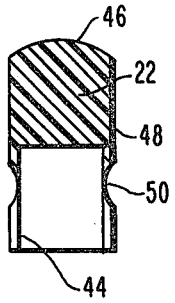
FIG. 5B is a sectional view of the vane of FIG. 5A along the lines VB—VB of that FIG. 5A.
Figure 6B:
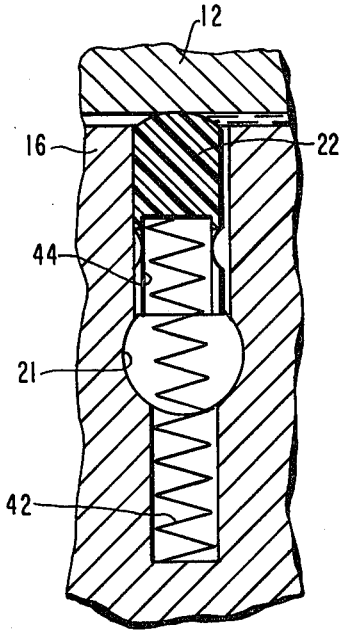
FIG. 6B is a schematic representation of the same structure at a position along the ring track just before the vane approaches the pressurized seawater inlet position.
Figure 6C:
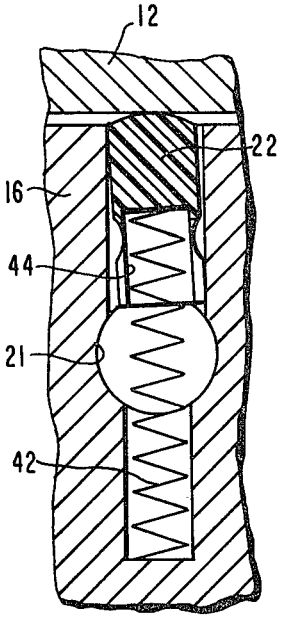
FIG. 6C is a schematic illustration of the vane and rotor slots at a position on the cam ring track just after the seawater outlet port has been passed.

The vane structure is best seen in FIGS. 5A and 5B, and the operation of the vanes is illustrated in FIGS. 2 and 6A, 6B and 6C. FIG. 6A corresponds to the circumferential position marked A in FIG. 2, which is along the major diameter portion of the ring track and after pressurized seawater has entered via inlet port so that the pressurized seawater 70 acts to rotate the rotor in a clockwise manner. The vane 22 is seen in sliding seal relationship against the interior surface of the cam ring track. Vane 22 is also cocked or tilted relative to the rotor radius or the slot walls so that pressurized seawater is directed into the slot area between the slot wall and the tilted vane. The seawater thus has access via groove 50 and radial slot 52 to the enlarged or bulbous slot portion 21, the pressurized seawater thus acts along with the spring members to radially force outwardly the vanes 22. The showing of FIG. 6B corresponds to the circumferential position marked B on FIG. 2 which is along a minor diameter portion of the cam ring track, and just before the rotor and vane approach the inlet port it can be appreciated there is a close tolerance between the rotor and cam ring track at this position with the arcuate end of the vane in sliding seal relationship to the cam ring track. In FIG. 6B the outlet port is to the left of the vane and the inlet port is to the right of the vane. FIG. 6C corresponds to the position designated C on FIG. 2, which is just after the vane has passed the outlet port.

The vane structure as seen in detail in FIGS. 5A and 5B as well as FIGS. 6A, 6B and 6C includes the radial slots 52 which extend from the side face grooves 50 to the wave base. The radial slots 52 preferably are connected to the spring apertures 44 in the vane base. The axial grooves are located as close to the rotor perimeter as practical, while ensuring the vane side face surface exposed to the pressurized seawater provides a large bearing surface for turning the rotor. As seen in FIG. 6A high pressure seawater acts on the vane side face to cock it and open a gap between the vane and the slot to allow high pressure fluid to flow to the vane base via the vane side face groove and radial slots. The side face groove in the vane is located close to the rotor perimeter when the vane is extended radially outward to ensure fluid flow without requiring a large gap between the vane and slot. A large gap would cause vane "face slap" and generally erratic operation and shortened lifetime for the motor.

The side face groove is rounded to minimize stress concentration in the vane which bends somewhat when the high pressure fluid acts on the vane as in FIG. 6A.

The bearing material which forms the vanes, side seal plates, and axial bearings has high strength, low friction coefficient, and desirable elastic modulus to exhibit acceptable wear rates during operation. The material selected Torlon 4275 exhibits about a 1% linear expansion when immersed in seawater for one month and its thermal coefficient of expansion is such that no problem of seizing of motor parts has been experienced. This material has high flexibility which combined with the inlet pressure pad areas designed into each end plate about the inlet and outlet passages, and the O-rings about these pressure pad areas between the side seal plates and end plates provides reliable seals. The inlet pressure pad areas are shaped to result in an approximate pressure balance between the inlet pressure on both sides of each side seal plate. The O-rings act as static seals for inlet and outlet flow passages.

The generally rectangular slots 20 include an enlarged bulbous portion 21 about midway down the slot depth. The bulbous portion 21 is situated so that when the vane 22 is fully extended radially outwardly, the base or bottom of the vane is still in the slot 20 above the bulbous portion 21 as seen in FIG. 6A. The vane 22 when fully recessed into the slot 20 has its base just into the bulbous portion 21 as seen in FIGS. 6B and 6C. The bulbous portion 21 is aligned with inlet-outlet aperture provided through the side seal plates. The slots 20 are about 0.151 inch wide for a 1.88 inch diameter rotor design. The vanes 22 can be tapered in width relative to the slot 20, from the vane base to the arcuate end to permit pressurized fluid to flow more easily down the gap between the vane and slot. For the 1.88 inch diameter rotor, 10 spaced apart slots 20 and vanes 22 have been found to give good performance. The generally rectangular cross-section vanes 22 have a width of about 0.148 to fit within the slot 20.

The flexible side seal plates perform a crucial sliding seal function selective to the high speed rotor, and for a 1.88 inch diameter rotor design, and for the Torlon material a side seal plate thickness of about 0.18 inch has been found effective. The flexibility of this side seal plate provides a dynamically balanced seal structure relative to the rotor and the end plates through which the pressurized seawater is admitted and returned. The radial grooves 60 in the side seal plates are about 0.03 inch deep.

The radial slots 52 in the vanes 22 preferably extend in from the side face 48 to merger with the aperture 44 for spring 42, with slots 52 being about 0.06 inch wide. The side face grooves 50 are about 0.01 inch deep and are formed with a radius of curvature and extend along the entire side face of vanes which are typically about 0.625 inch long.

In order to facilitate reliable operation with pressurized seawater the motor components are made of materials selected for their corrosion resistance and durability. Thus, motor components which perform a seal function are fabricated of a polyamide-imide plastic which contains graphite and polytetrafluoroethylene. The preferred material used includes Torlon 4275 and Torlon 4301, which are both trademarks of the Amoco Chemicals Corporation. The components fabricated of Torlon include the vanes 22, the side seal plates **24*a* and 24*b* and axial shaft bearings 64*a* and 64*b*. The O-rings utilized are conventional O-rings of Viton. The other motor components were fabricated of nickel alloy steel such as Inconel 625. The Inconel members include the rotor 16, the cam ring track 14, and the end plates 26*a* and 26*b*. The shaft 18 is integral with the rotor 16 and as such is also Inconel, as are the bolts and nuts 32 and 34** which hold the motor together.

In summary, a light weight durable seawater hydraulic motor has been developed which has a small overall volume of about 23 cubic inches and weighs less than about 5 pounds. The seawater motor has successfully delivered 3.3 horsepower at 1585 rpm with an 80 percent overall efficiency when supplied by 7 gallons per minute of seawater at 1000 pounds per square inch.

What we claim is:

1. A vane type hydraulic motor operable with seawater as the hydraulic fluid, comprising a centralized ring member having an eccentric ring track interior surface with a major and minor diameter portion, a rotor disposed within the ring, said rotor having a central axially extending shaft and a plurality of spaced apart circumferential slots for accepting vanes in the perimeter of the rotor;

spring loaded vanes disposed in said rotor slots, which vanes are biased outward against the ring track in sliding seal relation to the ring track wherein the spring loaded vanes are generally rectangular members having an arcuate outer end portion which serves as a sliding seal against the ring track, the base of the vane members has at least one spring receiving aperture therein, the vane member has side faces normal to the direction of rotor rotation, which side faces include grooves which extend along the entire extent of the opposed side faces in a non-radial direction normal to the direction of rotation, with a radially extending slot extending from the side face grooves to the base of the vane;

a pair of flexible side seal plates disposed on either side of the rotor and ring in sliding seal and thrust bearing relationship with the rotor and shaft, which flexible side seal plates have hydraulic fluid inlet and outlet passages;

a pair of end plates sealable to the side seal plates with fluid inlet and outlet ports and communicating end plate passages aligned with side seal plate passages to permit high pressure hydraulic fluid to be introduced into the space between the rotor and ring track at the ramps where the vanes follow the ring track from the minor to major diameter, and to permit low pressure flow to exit from the space between the rotor and ring track at ramps where the vanes follow the ring track from the major to minor diameter.

2. The vane type hydraulic motor set forth in claim 1, wherein the vanes have a thickness in the direction of rotation which is less than the rotor slot dimension to permit radial vane movement and to permit a predetermined cocking of the vane within the slot when high pressure hydraulic fluid is directed against one side face to permit hydraulic fluid flow to the base of the vane via the side face grooves and radial slots.

3. The vane type hydraulic motor set forth in claim 1, wherein the radially extending slot communicates with the spring receiving aperture in the vane base.

4. The vane type hydraulic motor set forth in claim 1, wherein the side face grooves are disposed along the radial extent of the side face such as to be closely spaced from the rotor outside diameter when the vane is spring biased outwardly within the rotor slot at the major diameter portion of the ring track.

5. The vane type hydraulic motor set forth in claim 1, wherein a pair of spaced apart spring receiving apertures are provided in the vane base, and a radially extending slot extends from each of the side face grooves to each spring receiving aperture.

6. The vane type hydraulic motor set forth in claim 1, wherein the side seal plate thickness and material elasticity are selected to provide a durable, thrust bearing side seal plate relative to the rotor.

7. The vane type hydraulic motor set forth in claim 1, wherein the flexible side seal plates have hydraulic fluid inlet and outlet passages, and radially extending grooves in the rotor facing surface of the flexible side seal plates from the hydraulic fluid outlet passages to a central aperture through which the rotor shaft extends, and annular shaft bearing members are disposed about the shaft between the shaft and the end plates, with axially extending grooves provided along the interior surface of spaced apart portions of the shaft bearing members, whereby low pressure hydraulic fluid entering through the seal plate outlet passage and radially extending grooves lubricates the thrust bearing side seal plate and also the shaft bearing member.

8. The vane type hydraulic motor set forth in claim 7, wherein the flexible side seal plates, shaft bearing members, and the vanes are formed of a material which exhibits, high corrosion resistance, low friction, high mechanical strength, and low swelling when in contact with seawater.

9. The vane type hydraulic motor set forth in claim 8, wherein the material is Torlon.

* * * * *